United States Patent [19]

Van Driesen et al.

[11] Patent Number: 4,686,028

[45] Date of Patent: Aug. 11, 1987

[54] UPGRADING OF HIGH BOILING HYDROCARBONS

[76] Inventors: Roger P. Van Driesen, 17 Fabrow Dr., Titusville, N.J. 08560; John R. Friday, 407 Shelbourne Ter., Ridgewood, N.J. 07450

[21] Appl. No.: 720,351

[22] Filed: Apr. 5, 1985

[51] Int. Cl.[4] ..... C10C 3/00; C10C 3/08

[52] U.S. Cl. ..... 208/86; 208/45; 208/108; 208/112; 208/309

[58] Field of Search ..... 208/45, 86, 108, 112, 208/309

[56] References Cited

U.S. PATENT DOCUMENTS

| | | | |
|---|---|---|---|
| 2,895,902 | 7/1959 | Peet | 208/86 |
| 3,321,395 | 5/1967 | Paterson | 208/86 |
| 3,364,138 | 1/1968 | Campagne | 208/86 |
| 3,544,449 | 12/1970 | Rapp | 208/86 |
| 3,775,292 | 11/1973 | Watkins | 208/309 |
| 4,125,459 | 11/1978 | Garwin | 208/309 |
| 4,126,538 | 11/1978 | Gondriaan | 208/86 |
| 4,411,768 | 10/1983 | Unger | 208/86 |
| 4,454,023 | 6/1984 | Lutz | 208/96 |

FOREIGN PATENT DOCUMENTS

| | | | |
|---|---|---|---|
| 536407 | 1/1957 | Canada | 208/86 |
| 82555 | 6/1983 | European Pat. Off. | 208/86 |
| 1267010 | 3/1972 | United Kingdom | 208/86 |

*Primary Examiner*—Asok Pal

*Attorney, Agent, or Firm*—Elliot M. Olstein

[57] ABSTRACT

A feed is subjected to deasphalting to separately recover oil, resin and pitch. The resin fraction is upgraded to valuable product, for example, by hydrogenation or visbreaking, and heavier components from the upgrading are recycled to the deasphalting for removing pitch-like components prior to being recycled to the upgrading step.

14 Claims, 1 Drawing Figure

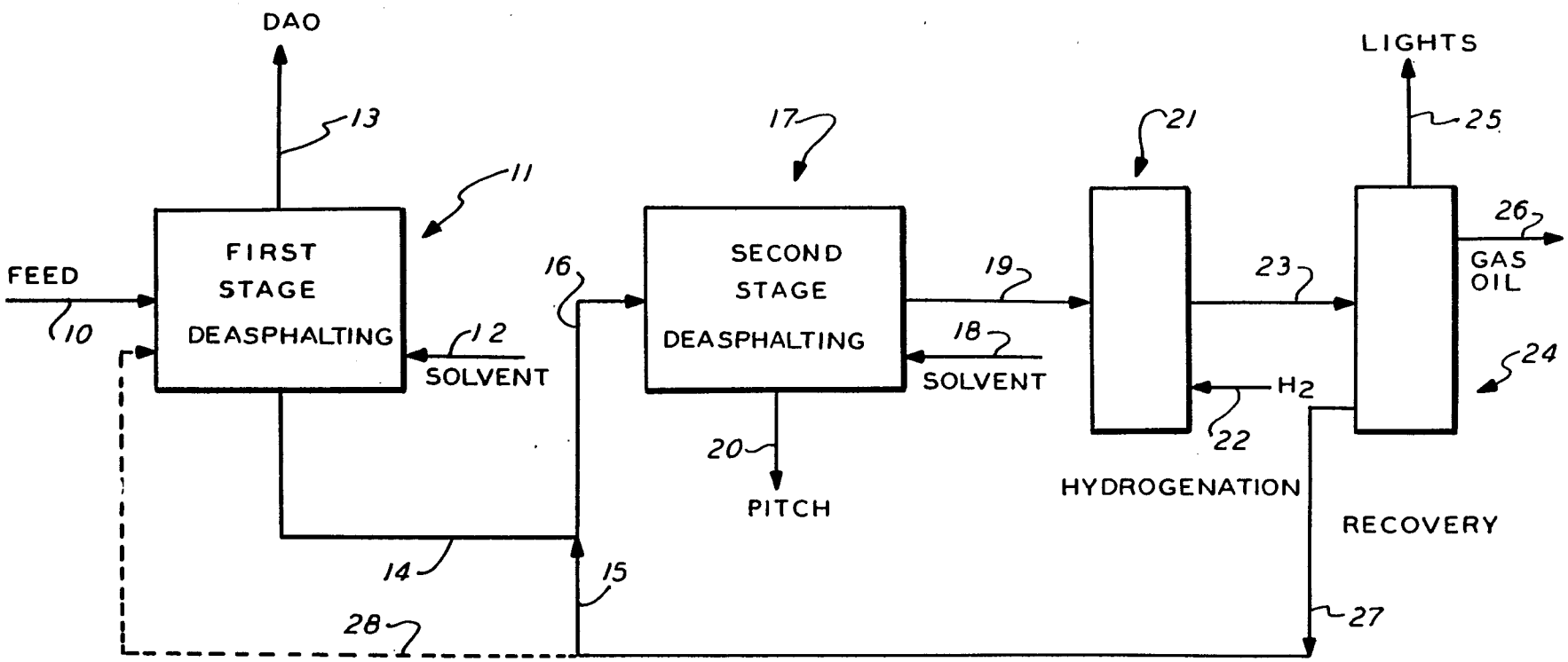
FEED
10
FIRST STAGE DEASPHALTING
11
DAO
13
SOLVENT
12
14
28
16
15
SECOND STAGE DEASPHALTING
17
PITCH
20
SOLVENT
18
19
HYDROGENATION
21
H2
22
23
RECOVERY
27
GAS OIL
26
LIGHTS
25
24

UPGRADING OF HIGH BOILING HYDROCARBONS

This invention relates to the upgrading of high boiling hydrocarbons, and more particularly to the hydrogenation of high boiling hydrocarbons so as to effect an upgrading of such hydrocarbons.

High boiling hydrocarbon materials, derived from either petroleum or coal sources, typically petroleum residuum or solvent refined coal are hydrogenated in order to effect an upgrading thereof. The hydrogenation may be effected for the purpose of removing sulfur and/or hydrocracking so as to produce lower boiling materials. In general such high boiling hydocarbons are fed directly to a hydrogenation operation.

In U.S. Pat. No. 3,775,292 there is proposed a process wherein a high boiling hydrocarbon is initially subjected to a deasphalting operation which involves separating resin and oil from pitch in a first zone, followed by separating oil from resin in a second deasphalting zone. The resin and oil are recovered as separate fractions, and each may be treated to effect upgrading thereof. In particular, U.S. Pat. No. 3,775,292 proposes hydrogenation of the resin fraction.

The present invention is directed to improving a process for upgrading a heavy hydrocarbon feed wherein feed is subjected to deasphalting prior to hydrogenation.

In accordance with one aspect of the present invention, a high boiling hydrocarbon feed which contains asphaltenes is subjected to a deasphalting operation to separate resin and pitch from oil, and pitch from resin to thereby recover, as separate fractions, oil, resin and pitch. The resin fraction is then upgraded with the effluent being treated to recover high boiling components from the effluent. At least a portion of such high boiling components are recycled to the upgrading operation, after being treated in the deasphalting operation to separate pitch components from such heavy components.

In this manner, coke precursors, which are present in the heavy recycle from the upgrading, are rejected with the pitch during the deasphalting portion of the operation, which extends the operability range of the upgrading particularly where such reaction is operated at higher levels of conversion.

The upgrading is preferably a hydrogenation operation; however, the present invention is also applicable to a visbreaking operation. The invention will be further described with respect to upgrading by hydrogenation.

The deasphalting of the high boiling hydrocarbon feed for the purpose of initially separating resin and pitch from the oil, followed by separating pitch from resin, may be accomplished in a single deasphalting zone, or in two or more deasphalting zones. In accordance with a procedure wherein the deasphalting is accomplished in two zones, in the first zone, resin and pitch are separated from the oil in the first zone, and the pitch and resin are introduced into a second zone wherein resin is separated from pitch. In such an embodiment, the recycle portion which is to be subjected to deasphalting so as to remove coke precursors is preferably introduced into the second zone so that such coke precursors are rejected with the pitch. Alternatively, such recycled portion, which is to be subjected to deasphalting may be introduced into the first zone, whereby the coke precursors are eventually rejected with the pitch in the second zone, but as should be apparent, in most cases, it is preferred to introduce the recycled portion directly into the second zone.

In accordance with an alternative embodiment, the deasphalting may be accomplished in a single zone, with the oil being recovered as a lighter fraction, the resin as an intermediate fraction, and the pitch as a heavy fraction. In such an embodiment, the recycle portion, which is to be subjected to deasphalting is introduced into the deasphalting zone wherein coke precursors are rejected with the pitch.

Applicant has found that notwithstanding the fact that the resin portion of the residuum is initially subjected to a deasphalting operation so as to remove pitch, the high boiling components from the hydrogenation which are to be recycled include coke precursors, which adversely affect the ability to convert such resin fraction to lower boiling components. Accordingly, in accordance with the present invention, at least a portion of the material which is to be recycled, is introduced into the deasphalting operation so as to reject such coke precursors along with the pitch fraction recovered in the deasphalting operation.

Although the term "deasphalting" commonly refers to separating oil from a pitch fraction, which includes the resin, the term "deasphalting" or "deasphalting zone", as used herein, refers to an operation wherein there is recovered from the high boiling hydrocarbon, as separate fractions, oil, resin and pitch, whether such recovery is accomplished in a single zone, or more than one zone. In accordance with the present invention, the recycled portion recovered from the hydrogenation of the resin fraction, which is to be subjected to the deasphalting, must be introduced into the portion of the deasphalting operation, wherein pitch is recovered as a separate fraction, so that coke precursors present in the recycle are rejected with the pitch. As hereinabove indicated, however, such recycle portion may initially be introduced into a portion of the deasphalting operation in which pitch is not recovered as a separate fraction, providing that such recycle portion is eventually treated in the portion of the deasphalting operation wherein pitch is rejected or recovered as a separate fraction.

In accordance with one embodiment, deasphalting, may be effected as generally practiced in the art whereby the high boiling hydrocarbon feed is introduced into a deasphalting zone to reject pitch and resin from the oil to thereby recover a deasphalted oil. Techniques for accomplishing such deasphalting are generally known in the art, and generally involve the use of a suitable solvent for rejecting an asphalt pitch and resin from the oil.

Subsequently, the pitch and resin are treated in a second zone so as to reject an asphalt pitch from the resin fraction, whereby there is recovered from such zone, as separate fractions, resin and an asphalt pitch. The pitch and resin may be separated from each other in a second zone by the use of an appropriate solvent and conditions so as to reject the pitch from the resin.

Procedures for separately recovering deasphalted oil, resin and pitch fractions are generally described in U.S. Pat. No. 3,830,732 and U.S. Pat. No. 4,101,415. In accordance with the present invention, coke precursors present in a recycle to the hydrogenation operation are rejected in the pitch fraction recovered from the deasphalting.

In general, deasphalting in two zones so as to separate oil from both pitch and resin in a first zone, and to separate resin from pitch in a second zone is accomplished by the use of a first deasphalting solvent in the first zone, and a second deasphalting solvent in the second zone, with the second deasphalting solvent generally having at least one more carbon atom per molecule than the first deasphalting solvent. For example, the first deasphalting solvent may be propane and/or butane and the second deasphalting solvent may be pentane. It is to be understood, however, that the first and second deasphalting solvent may be identical and in such a case, different solvent ratios and/or temperatures are used in the first and second zones so as to accomplish the required separation.

The temperature which is used is generally one at which the separated pitch fraction can flow, and the pressure is selected so that the deasphalting solvent is in liquid form at the operating temperature. In general, temperatures are within the range of from 50° F. to 600° F. The solvent to feed ratio may vary over a wide range; e.g., from 2:1 to 50:1.

As a representative procedure, deasphalting in a first zone to separate oil from both resin and pitch may be accomplished by use of propane or butane at a solvent to feed ratio of about 6:1 and a temperative of about 190° F. to 230° F., and in a second zone to separate pitch from resin, by use of pentane at a feed ratio of about 8:1 and a temperative of about 280° F. to 310° F. The pressure in both zones is at a value to maintain liquid conditions.

In accordance with another procedure, pitch may be initially separated from both the resin and oil, followed by separation of oil from resin. Thus, for example, the feed may be contacted in a column with a mixture of butane and pentane (solvent to feed ratio of from 4:1 to 8:1) at a temperature of 250° F. to 325° F. to reject the pitch, followed by subjecting the separated mixture of resin, oil and solvent to a higher temperature (for example in the order of 300° F.) to separate resin from oil. In such an embodiment, the recycle stream is introduced into the column to reject coke precursors with the pitch. It is to be understood that a procedure for initially rejecting pitch, followed by separation of oil and resin may also be accomplished by other procedures; e.g., as described in U.S. Pat. No. 3,775,292. In accordance with the present invention, the heavy material which is recovered from the hydrotreating and which is to be recycled to the hydrotreating is introduced into the portion of the procedure wherein the asphaltic pitch is separated from the feed.

In most cases, the deasphalting is accomplished by the use of a suitable solvent, such as a light hydrocarbon including ethane, methane, propane, butane, isobutane, pentane, isopentane, neopentane, hexane, isohexane, heptane, the mono-olefinic counterparts thereof, etc. Furthermore, the solvent may be a normally liquid naphtha fraction containing hydrocarbons having from about five to about 14 carbon atoms per molecule, and preferably a naphtha distillate having an end boiling point below about 200° F.

If more than one zone is employed for accomplishing the deasphalting, the same or different solvent may be employed in each of the zones.

The high boiling hydrocarbons which are treated in accordance with the present invention are hydrocarbon feeds which generally have at least 25%, by volume, of material boiling about 950° F. The invention has particular applicability to treating residues (residual oils). Such hydrocarbon feeds are generally contaminated with asphaltenes, and are sometimes referred to in the art as "black oils". As representative examples of suitable feeds, which may be derived from either petroleum and/or coal sources, there may be mentioned a petroleum residuum, such as atmospheric tower bottoms or vacuum tower bottoms or heavy crudes or tars containing small amounts of material boiling below 650° F., a solvent refined coat, various bitumens, heavy oils extracted from tar sands. These and other feedstocks should be apparent to those skilled in the art from the teachings herein.

The resin fraction recovered from the deasphalting operation is upgraded to lower boiling materials by employing a hydrogenation process (sometimes referred to as hydrocracking) of a type known in the art. The hydrogenation may be accomplished in either a fixed bed, expanded bed (ebullated bed) or a coil. Although in accordance with a preferred procedure, the resin fraction is upgraded in an ebullated bed, the scope of the invention is not limited to such a procedure.

In general, such hydrogenation is accomplished in the presence of a suitable catalyst of a type known in the art, which is generally comprised of a group VI-B metal and group VIII metal. The catalyst is generally supported on a suitable support, such as a refractory inorganic oxide, such as alumina or may be supported on silica-aluminum. As representative examples of suitable catalysts for hydrogenation of the resin fraction, there may be mentioned cobalt-molybdate, nickel-molybdate, cobalt-nickel molybdate, tungsten-nickel sulfide, tungsten sulfide, etc.

The conditions employed for effecting such hydrogenation are generally known in the art, and as representative examples of general conditions, there may be mentioned pressures from 200 to 3000 psig, temperatures from 600° F. to 900° F., and liquid hourly space velocities from 0.1 to 2.50. The hydrogenation is accomplished by use of an effective amount of gaseous hydrogen, with such hydrogen generally being employed in amounts of 500 to 30,000 SCF per barrel of feed. The upgrading by hydrogenation may be accomplished in one or more reactors, as generally known in the art.

As hereinabove indicated, a portion of the product produced in the hydrogenation of the resin fraction is recovered for recycle to the hydrogenation, after being subjected to deasphalting in order to reject any coke precursors present in the recycle, along with the pitch fraction rejected from the fresh feed. The portion of the product which is employed for recycle is generally comprised of at least 25%, by volume of 850° F.+ components present in the product. In most cases, all of the recycle is comprised of 850° F.+ components (nominal boiling point); however, it is to be understood that depending on the desired product distribution some lighter components may also be recycled.

In cases where the recycle includes components in addition to those which boil above about 850° F., the five volume percent distillation temperature of such recycle portion is generally at least 450° F., preferably at least 550° F., and in most cases at least 600° F. In accordance with a preferred embodiment of the present invention, all of the recycle portion is subjected to the deasphalting; however, it is to be understood that a portion of the recycle may be subjected to the deasphalting, and the remaining portion of the recycle may be directly recycled to the hydrogenation.

In general, the amount of material recycled to the hydrogenation is sufficient to provide from 0.1 to 1 to about 2 to 1, preferably from 0.3:1 to 1:1 of recycle per part of fresh feed resin fraction to the hydrogenation.

The present invention is particularly applicable wherein the hydrogenation is effected in a manner such as to provide for severe conditions; i.e., high conversion of 850° F.+ components of the feed. Thus, for example, particularly good results are obtained when conversions of 850° F.+ components in the resin feed are in the order of at least 70%, and generally at least 90%.

The coke precursors which are present in the recycle portion are characterized as being included in the heptane insoluble material.

The invention will be further described with respect to an embodiment thereof illustrated in the drawing, wherein:

BRIEF DESCRIPTION OF THE DRAWING

The drawing is a simplied schematic flow diagram of a preferred embodiment of the invention.

It is to be understood, however, that the scope of the invention is not to be limited to such an embodiment.

Referring now to the drawing, a feed comprised of a high boiling hydrocarbon, such as a vacuum bottoms, in line 10, is introduced into a first stage deasphalting zone, schematically generally indicated as 11, along with an appropriate deasphalting solvent, introduced through line 12. The deasphalting zone 11 is designed and operated so as to recover deasphalted oil ring in deasphalting solvent through line 13, and a bottoms, comprised of pitch and resin through line 14.

The deasphalted oil in line 13 may be employed as generally practiced in the art. Thus, for example, the deasphalted oil in line 13 may be employed as feed to a hydrocracking unit or a catalytic cracking unit.

The bottoms comprised of pitch and resin in line 14, is combined with recycle in line 15, obtained as hereinafter described, and the combined stream in line 16 is introduced into a second stage deasphalting zone, schematically generally indicated as 17, along with deasphalting solvent in line 18.

The second stage deasphalting zone is designed and operated so as to reject pitch from the resin, and thereby recover the resin fraction, rich in solvent, in line 19, and a pitch fraction through line 20. As hereinafter indicated, the pitch fraction recovered through line 20 includes coke precursors rejected from the recycle stream.

The pitch recovered through line 20 may be employed as generally known in the art; for example, as a fuel.

The resin fraction recovered from the feed, as well as the recycle materials, in line 19, are introduced into a hydrogenation zone, schematically generally indicated as 21, along with hydrogen to effect upgrading of the feed to lower boiling components. In hydrogenation zone 21, both hydrocracking and hydrogenation of the feed is accomplished. In accordance with a preferred embodiment, the hydrogenation in zone 21 is accomplished in an expanded bed of catalyst, as known in the art. It is to be understood, however, that other forms of hydrocracking of feed in the presence of catalyst may also be employed within the spirit and scope of the invention.

Product is withdrawn from hydrogenation zone 21 through line 23, and such product includes lower boiling components, as well as higher boiling components which are basically unreacted feed. The product in line 23 is introduced into a suitable separation and recovery zone schematically generally indicated as 24 in order to recover distillate and gas oil products, as well as unreacted heavy components. As particularly shown, light distillates are recovered through line 25, and gas oil is recovered through 26.

Heavier components, and in particular materials boiling above 850° F., which include coke precursors, are recovered from zone 24 through line 27, and as particularly shown, all of such material is recycled to the second stage deasphalting zone 17 through line 15. As an alternative, all or a portion of such material may be introduced into the first stage deasphalting zone 11 through line 28.

As hereinabove described, by introducing at least a portion of the recycle components into the deasphalting operation, and in particular to at least the portion of the deasphalting operation in which pitch is recovered as a separate fraction, coke precursors which are present in such recycle, are rejected from the recycle along with the pitch in the fresh feed, which extends the operability of the hydrogenation operation, particularly at high levels of conversion.

The hereinabove described embodiment may be modified within the spirit and scope of the present invention. Thus, for example, although in accordance with a preferred embodiment, there are two stages for the deasphalting, deasphalting may be accomplished in a single zone wherein there is recovered, as separate fractions, deasphalted oil, resin and pitch.

As a further modification, which is less preferred, first stage deasphalting may be accomplished in a manner such that deasphalted oil and resin are initially separated from pitch, followed by a second stage wherein resin is separated from deasphalted oil. In such a modification, the recycle would be introduced into a first stage so that coke precursors may be rejected along with the pitch.

As another modification, zone 21 may be a visbreaking zone operated at conditions known in the art instead of a hydrogenation zone.

The above modifications and others should be apparent to those skilled in the art from the teachings herein.

In a representative operation, 100 volumes of residuum is treated in zone 11 with a mixture of propane and butane (solvent to feed ratio of 6:1) at a temperative of about 200 degree F. to produce 50.6 volumes of deasphalted oil and 49.4 volumes of pitch and resin. The 49.4 volumes of pitch and resin and 26.9 volumes of recycle (line 15) are treated in zone 17 with pentane solvent (solvent to feed ratio of about 8.1) at a temperature of about 300 degree F. to produce 59.9 volumes of resin (line 19) and 16.5 volumes of pitch (line 21). Hydrogenation in zone 21 in an ebullated bed is operated at a severity to produce 6.4 volumes of naphtha, 10.4 volumes of middle distillate and 18.1 volumes of gas oil.

The present invention is particularly advantageous in that hydrogenation can be accomplished at a higher severity to produce higher yields of distillates. Such a result can be achieved while minimizing, if not eliminating, the problems caused by coking during a high severity operation. These and other advantages should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. A process for upgrading a high boiling hydrocarbon, comprising:

deasphalting the high boiling hydrocarbon to recover as separate fractions, deasphalted oil, resin and pitch; upgrading the resin fraction to produce an effluent containing upgraded product and high boiling components; recovering high boiling components from the effluent; subjecting said deasphalting at least a portion of the recovered high boiling components to reject coke precursors in the (pitch fraction) high boiling components portion prior to recycle thereof to said upgrading with the resin fraction; and thereafter recyling the high boiling components portion with the resin fraction to said upgrading.

2. The process of claim 1 wherein the resin fraction upgrading is visbreaking.

3. The process of claim 1 wherein the resin fraction upgrading is hydrogenation.

4. The process of claim 3 wherein the deasphalting initially separates a pitch and resin fraction from a deasphalted oil fraction in a first zone and then separates a pitch fraction from a resin fraction in a second zone, and the recovered high boiling components is introduced into one of the first and second zone.

5. The process of claim 4 wherein the recovered high boiling components are introduced into the second zone.

6. The process of claim 5 wherein at least 70% of the 850° F.+ components are converted in the hydrogenation.

7. The process of claim 6 wherein at least 90% of the 850° F.+ components are converted in the hydrogenating.

8. The process of claim 6 wherein hydrogenating is effected in an ebullated catalyst bed at a temperature of from 600° F. to 900° F.

9. The process of claim 8 wherein the high boiling hydrocarbon is a petroleum residuum.

10. The process of claim 3 wherein the deasphalting initially separates a pitch fraction from an oil and resin fraction in a first zone and then separates an oil fraction from a resin fraction in a second zone and the recovered high boiling components are introduced into the first zone.

11. A process of upgrading a residual oil, comprising:

deasphalting the residual oil in a first zone and in a second zone, said deasphalting in the first zone separating a deasphalted oil fraction from a pitch and resin fraction and said deasphalting in the second zone separating a pitch fraction from a resin fraction; hydrogenating the resin fraction in an expanded bed to produce an effluent containing upgraded product and remaining high boiling components; (and) introducing remaining high boiling components into the second zone of the deasphalting to reject coke precursors with the pitch prior to recycle to the expanded bed hydrogenating with the resin fraction; and thereafter recycling remaining high boiling components to the expanded bed hydrogenating with the resin fraction.

12. The process of claim 11 therein the hydrogenating is effected to provide a conversion of at least 70% of the components in the resin fraction which boil above 850° F.

13. The process of claim 12 wherein all of the remaining high boiling components recovered from the effluent are introduced into the second zone of the deasphalting.

14. The process of claim 12 wherein the residual oil is a petroleum residuum.

* * * * *

UNITED STATES PATENT AND TRADEMARK OFFICE

CERTIFICATE OF CORRECTION

PATENT NO. : 4,686,028

DATED : August 11, 1987

INVENTOR(S) : Van Driesen, et al

It is certified that error appears in the above-identified patent and that said Letters Patent is hereby corrected as shown below:

Column 7, line 10, after "subjecting" and before "said", insert --to--.

Column 7, line 13, delete "(pitch fraction)".

Column 8, line 21, delete "(and)".

Signed and Sealed this

Eighteenth Day of July, 1989

*Attest:*

DONALD J. QUIGG

*Attesting Officer*

*Commissioner of Patents and Trademarks*